US006557189B2

(12) United States Patent
Von Schroeter

(10) Patent No.: US 6,557,189 B2
(45) Date of Patent: May 6, 2003

(54) INVALID POSITIONING DEVICE

(75) Inventor: Philip Von Schroeter, Gloucester (GB)

(73) Assignee: Arjo Limited, Gloucster (DE)

( * ) Notice: Subject to any disclaimer, the term of this patent is extended or adjusted under 35 U.S.C. 154(b) by 0 days.

(21) Appl. No.: 09/899,133

(22) Filed: Jul. 6, 2001

(65) Prior Publication Data

US 2002/0002740 A1 Jan. 10, 2002

(30) Foreign Application Priority Data

Jul. 6, 2000 (GB) ..... 0016530

(51) Int. Cl.[7] ..... A61G 7/10

(52) U.S. Cl. ..... 5/86.1; 5/85.1; 5/87.1; 414/921

(58) Field of Search ..... 5/83.1, 85.1, 86.1, 5/87.1; 414/921

(56) References Cited

U.S. PATENT DOCUMENTS

| | | | | | |
|---|---|---|---|---|---|
| 4,144,713 | A | * | 3/1979 | Clark et al. | 5/87.1 |
| 4,290,423 | A | * | 9/1981 | Kleinwolterink | 5/83.1 |
| 4,918,771 | A | * | 4/1990 | James | 5/87.1 |
| 4,985,947 | A | * | 1/1991 | Ethridge | 5/86.1 |
| 5,649,329 | A | | 7/1997 | Horcher et al. | 5/83.1 |
| 5,987,664 | A | * | 11/1999 | Somerton et al. | 5/83.1 |
| 6,219,862 | B1 | * | 4/2001 | Horcher et al. | 5/81.1 R |
| 6,389,619 | B1 | * | 5/2002 | Dunn | 5/81.1 R |

FOREIGN PATENT DOCUMENTS

| | | | |
|---|---|---|---|
| DE | 9317942.1 | * | 5/1994 |
| EP | 0 895 768 A2 | | 2/1999 |
| GB | 2127931 A | * | 4/1984 |
| GB | 2 267 475 | | 12/1993 |
| GB | 2 295 602 A | | 5/1996 |
| GB | 2 327 931 | | 2/1999 |
| GB | 2 346 361 | | 8/2000 |

* cited by examiner

*Primary Examiner*—Thomas B. Will
*Assistant Examiner*—Tara L. Mayo
(74) *Attorney, Agent, or Firm*—Young & Thompson

(57) ABSTRACT

An invalid positioning device comprising a support structure, a lifting element which is angularly displaceable about a main horizontal axis relative to the support structure, and a power operated mechanism for pivoting the lifting element about the the main horizontal axis. The power operated mechanism is arranged such that the torque applied by the power operated mechanism decreases as the lifting element moves away from one extreme position and increases again as the lifting element approaches its other extreme position and such that the angular speed of the lifting element increases as it moves away from one extreme position and decreases as it approaches its other extreme position.

13 Claims, 5 Drawing Sheets

FIG 1

INVALID POSITIONING DEVICE

INTRODUCTION

This invention relates to invalid positioning devices and particularly, but not exclusively, to an invalid positioning device for use with slings in which invalids are suspended during lifting.

BACKGROUND OF THE INVENTION

Invalid positioning devices having a lifting element pivotable about a main horizontal axis are well known. These devices typically come in two types. One type acts as a standing aid for a patient and the other type utilises a full-body sling by which the patient can be completely suspended from the device. Typically, the lifting elements of both types of device are power operated by rotary or linear drive means.

One drawback associated with the use of rotary drive means is that a rotary actuator only produces a constant torque and the lifting element will thus only be pivotable at a constant angular speed over its range of angular displacement.

A further drawback lies in the fact that rotary actuators which are able to produce a sufficient amount of torque while not being too oversized have to be purpose built and as such are not cost-effective.

Yet a further drawback exists when using a rotary actuator in the second type of invalid positioning device, such as is known from GB-A-2127931. In this type of arrangement, the rotary drive means is housed adjacent to the horizontal axis about which the lifting element, in the form of a sling hanger, pivots. This causes problems when the sling hanger is presented with fluids, such as in the case when an invalid patient is lowered into a bath of water. Although some water proofing means can be applied, this will invariably be inadequate and undesirable seepage and contact will still occur.

A drawback associated with the use of linear drive means is that a lifting element, operated via a linear actuator incorporated in the linear drive means, typically exhibits its greatest angular speed about the main horizontal axis when at the ends of its range of angular displacement, and typically exhibits a maximum torque in the region of the mid-point of its range of angular displacement.

The present invention seeks to provide an invalid hoist which overcomes these drawbacks.

SUMMARY OF THE INVENTION

According to one aspect of the present invention, there is provided an invalid positioning device comprising a support structure, a lifting element angularly displaceable about a main horizontal axis relative to the support structure between two extreme positions and a power operated mechanism for pivoting the lifting element about said main horizontal axis, the power operated mechanism being arranged such that the torque applied by the power operated mechanism decreases as the lifting element moves away from one extreme position and increases again as the lifting element approaches its other extreme position and such that the angular speed of the lifting element increases as it moves away from one extreme position and decreases as it approaches its other extreme position.

According to a second aspect of the invention, there is provided an invalid positioning device comprising a support structure, a lifting element angularly displaceable about a main horizontal axis relative to the support structure between two extreme positions and a power operated mechanism for pivoting the lifting element about said main horizontal axis, wherein the power operated mechanism comprises an actuator and a lever, a first part of which is supported for pivotable movement relative to the support structure about a second horizontal axis spaced from said main horizontal axis and a second part of which is connected to the lifting element by a slidable connection which moves closer to said main horizontal axis as the lifting element moves away from one extreme position towards an intermediate position and then moves away from said main horizontal axis as the lifting element moves from said intermediate position towards its other extreme position.

The invention will now be more particularly described, by way of example, with reference to the accompanying drawings.

DESCRIPTION OF THE PREFERRED EMBODIMENT

Figure 1:
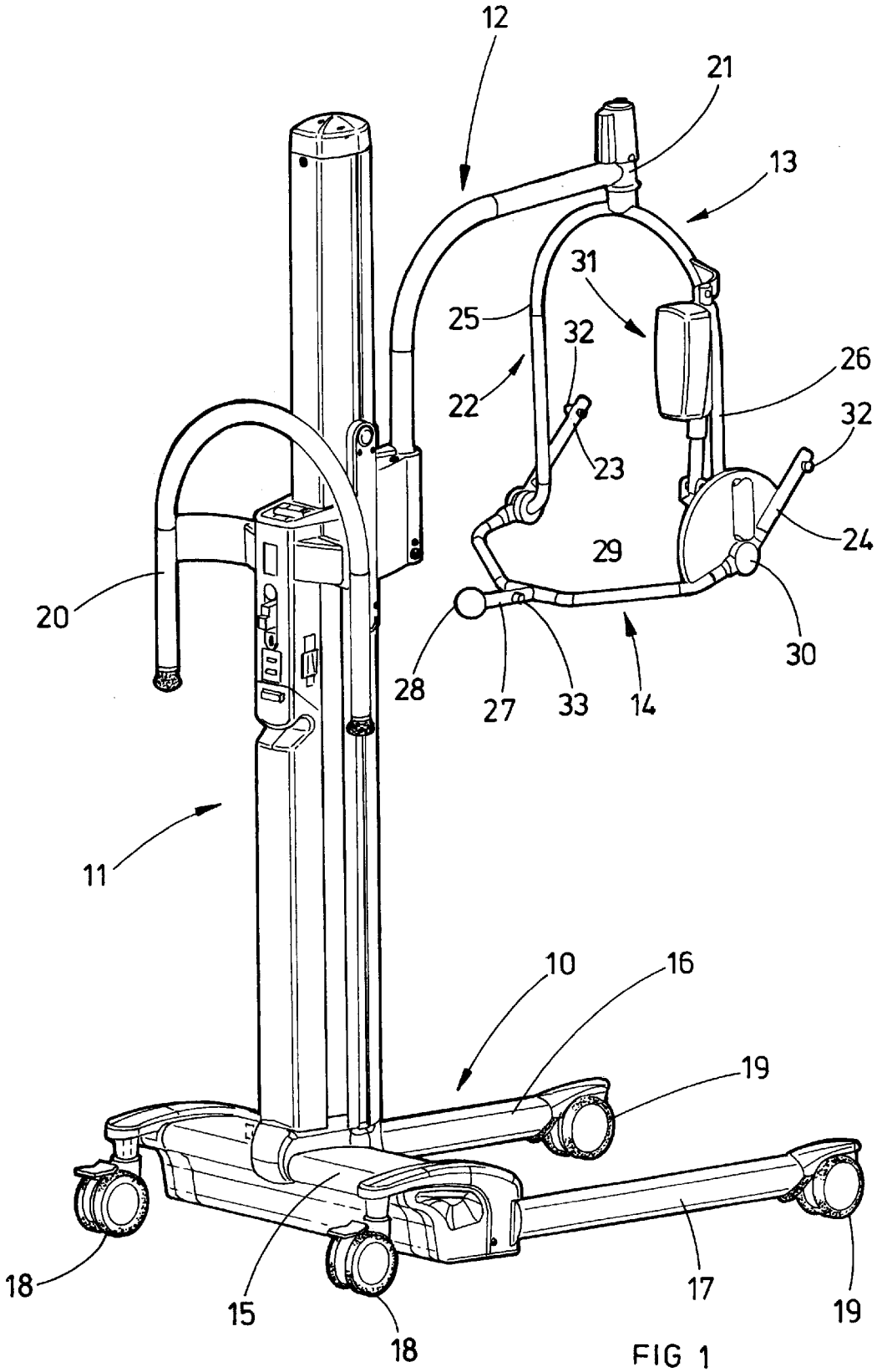
FIG. 1 is a perspective view of one embodiment of an invalid positioning device according to the present invention.
Figure 2:
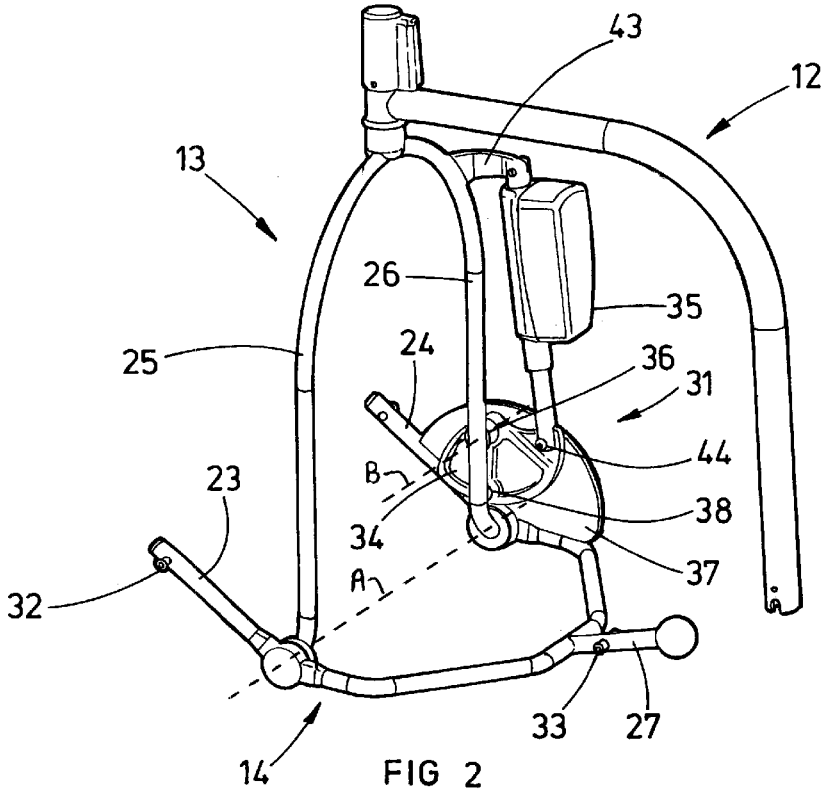
FIG. 2 is a perspective view of part of the invalid lifting device shown in FIG. 1, from one side.
Figure 3:
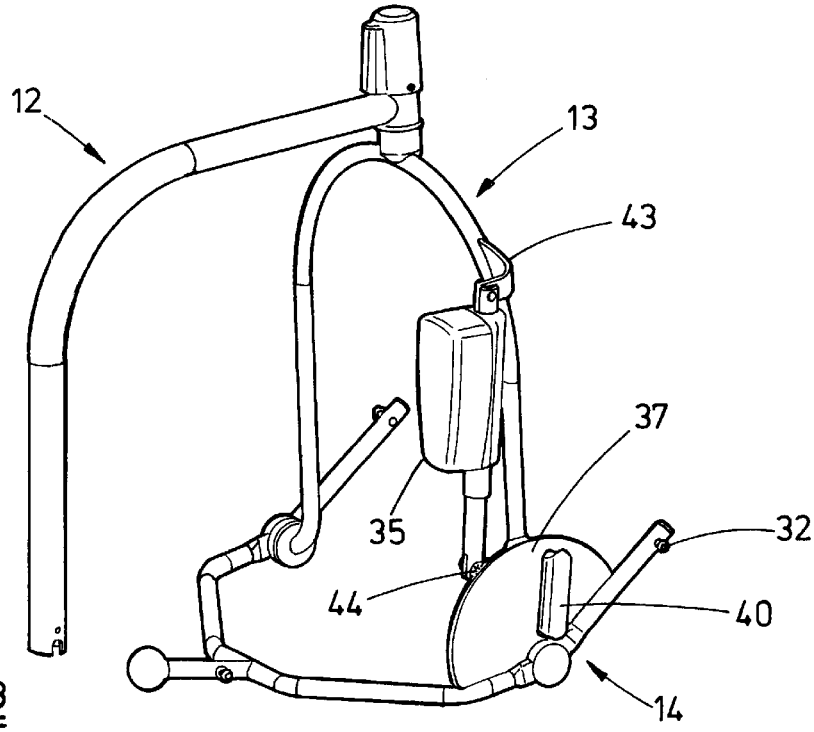
FIG. 3 is a perspective view of the part of the invalid lifting device shown in FIG. 2, from the other side.
Figure 4:
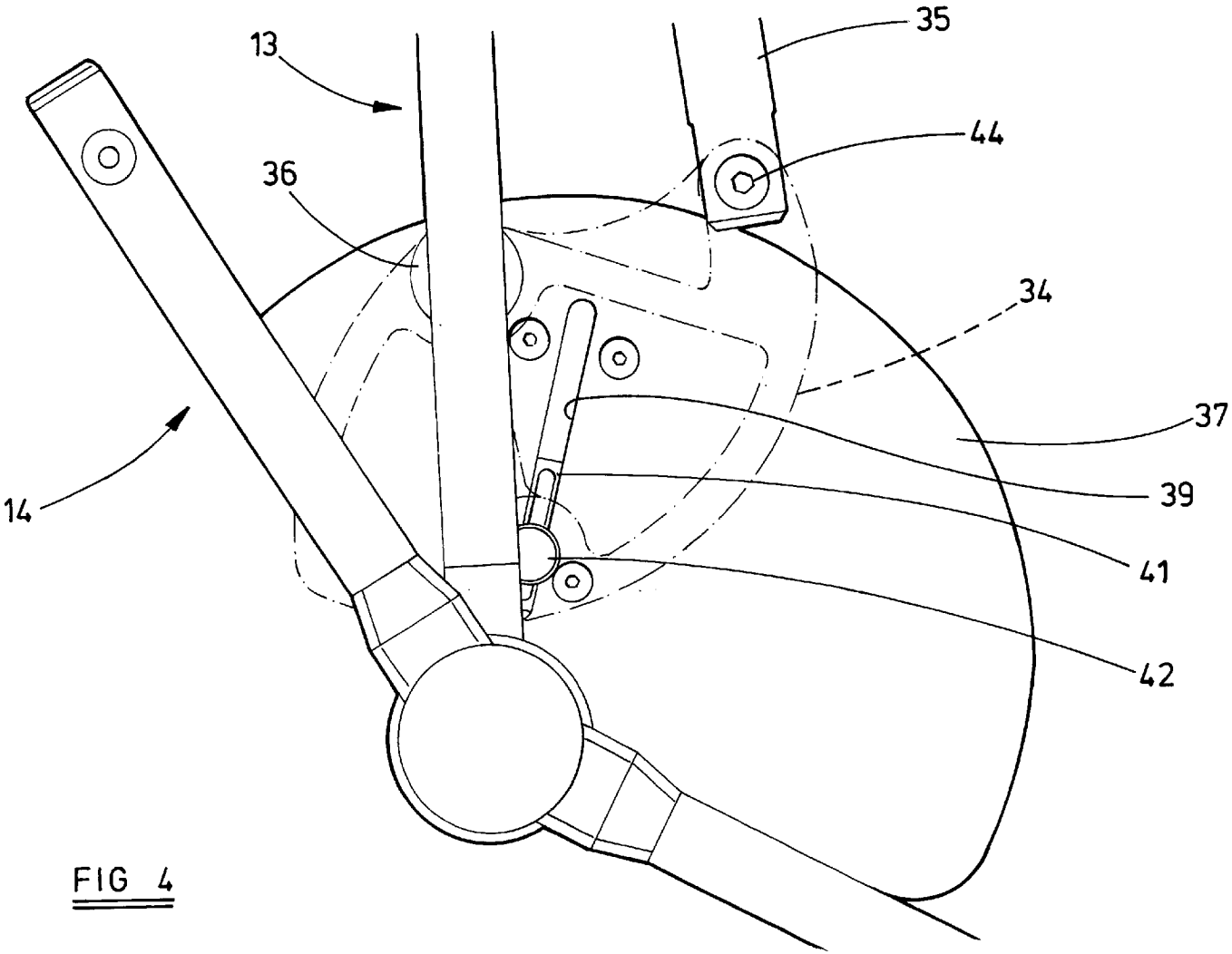
FIG. 4 is a fragmentary side view of the invalid lifting device on an enlarged scale.

Referring firstly to FIG. 1 of the drawings, the invalid positioning device shown therein is of the second type mentioned hereinbefore and comprises a support structure, which includes a chassis 10, a lifting column 11 upstanding from the chassis 10, a lifting arm 12 projecting from the lifting column 11, a sling hanger support 13 at the free or outer end of the lifting arm 12, and a lifting element which takes the form of a sling hanger 14 supported by the sling hanger support 13.

The chassis 10, lifting column 11 and lifting arm 12 are now well known.

The chassis 10 comprises a transversely extending part 15 from which the lifting column 11 upstands and two arms 16 and 17 pivotable relative to the part 15 between positions in which they extend parallel to one another and positions in which they are splayed apart at their outer free ends. The part 15 has two castors 18 and a further castor 19 is provided at the free end of each of the arms 16 and 17.

The lifting column 11 includes a motor driven actuator (concealed within the column 11) for raising and lowering the lifting arm 12 relative to the lifting column 11. A rechargeable battery is mounted on the lifting column 11 and powers the motor driven actuator.

A handle 20 is provided on the lifting column 11 whereby an attendant can move the invalid hoist along the floor.

The sling hanger support 13 is in the form of an inverted, generally U-shaped, member which is mounted in a vertical bearing 21 at the free outer end of the lifting arm 12 to turn about a rigid vertical or substantially vertical axis.

The sling hanger 14 is typically of unitary construction and has generally U-shaped part 22 having two limbs 23 and 24 which are pivotally connected to the lower ends of limbs 25 and 26, respectively, of the sling hanger support 13 for pivotable movement about a common main horizontal axis A. The sling hanger 14 also has a central arm 27 extending from the base of the U-shaped part 22 away from the said main horizontal axis. A hand grip 28 may be provided at the free end of the arm 27.

A first simple pivotable connection 29 is provided between the lower end of the limb 25 of the sling hanger support 13 and the limb 23 of the sling hanger 14, and a second simple pivotable connection 30 is provided between the lower end of the limb 26 of the sling hanger support 13 and the limb 24 of the sling hanger 14.

A power operated mechanism, generally referenced at 31, is supported by the sling hanger support 13 at a position elevated in relation to the pivotable connections 29 and 30. The power operated mechanism 31 enables power assisted pivoting of the sling hanger 14 relative to the sling hanger support 13 about the said main horizontal axis.

Sling attachments 32, in the form of headed studs, are provided at or adjacent to the free ends of the limbs 23 and 24, and two further sling attachments, also in the form of headed studs 33, are provided on opposite sides of the arm 27. The studs 33 could, however, be replaced by a single stud.

Referring now to FIGS. 2 to 5, the power operated mechanism 31 will now be more particularly described. This mechanism comprises a lever 34 of generally segmental shape and an actuator 35.

The level 34 is connected to the limb 26 of the sling hanger support 13 by a pivotable connection 36 for pivotable movement relative to the support 13 about a second horizontal axis B which is parallel to and in fixed spaced apart relationship to said main horizontal axis.

The lever 34 is connected to an arcuate plate 37 attached to the limb 24 of the sling hanger 14 by a slidable connection 38. The slidable connection includes a guideway 39 comprising an elongate slot in the plate 37 and a correspondingly shaped recess in a housing 40 attached to the outer side of the plate 37. The slidable connection also includes a guide element 41 (best shown in FIG. 4) which is slidably received in the recess of the guideway 39 and which is attached to the lever 34 by a headed pin 42 extending through the slot of the guideway 39.

The actuator 35 is typically a linear actuator, one end of which is supported for pivotable movement by a bracket 43 attached to the sling hanger support 13 and the other end of which is connected to the lever 34 by a pivotable connection 44. The motor of the actuator 35 is preferably at its upper end.

As shown, the guideway 39 extends away from a position adjacent to the main horizontal axis.

Figure 5A:
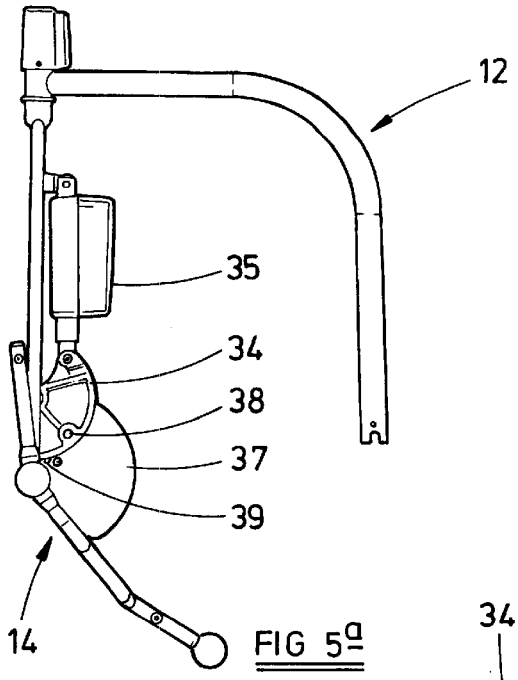
FIGS. 5*a* to 5*c* are side views of the part of the invalid lifting device shown in FIGS. 1 and 2 illustrating the range of movement of the sling hanger relative to the sling hanger support.
Figure 5B:
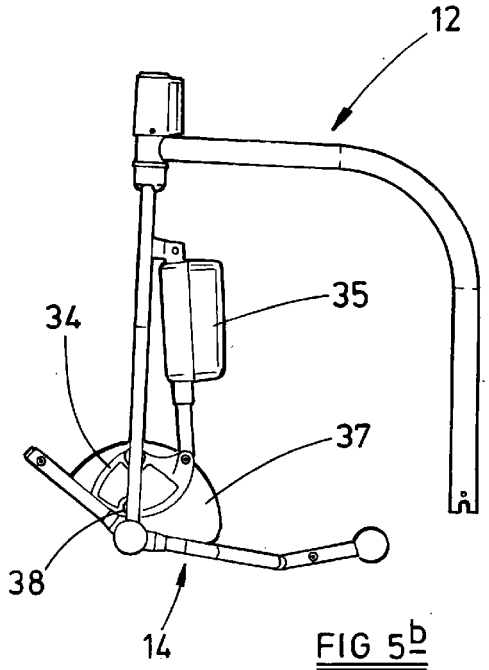
Figure 5C:
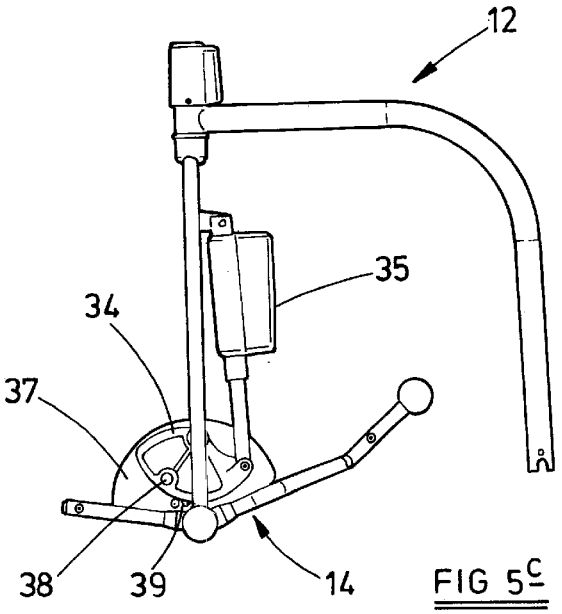

FIGS. 5*a* and 5*c* show the sling hanger 14 at or adjacent to first and second extreme positions, respectively. At one extreme position, the limbs 23 and 24 of the sling hanger 14 are at approximately 10° to the limbs 25 and 26 of the sling hanger support 13 (best shown by FIG. 5*a*), and at the other extreme position, the limbs 23 and 24 are at approximately 90° to the limbs 25 and 26 (best shown by FIG. 5*c*). FIG. 5*b* is an arbitrary view showing the sling hanger 14 between the two extreme positions.

As can be seen in FIG. 5*a*, when the sling hanger 14 is at or adjacent to its first extreme position, the guide element 41 is situated adjacent to the end of the guideway 39 remote from the main horizontal axis. At this position, the power operated mechanism 31 will apply a relatively large torque T to the sling hanger 14 and the latter will be displaced angularly at a relatively low angular speed v.

As the constant rate of extension of the linear actuator 35 continues (FIGS. 4 and 5*b*), angular displacement of the lever 34 about said second horizontal axis will cause the guide element 41 to move along the guideway 39 towards the main horizontal axis. The torque T applied to the sling hanger 64 will thus diminish and the angular speed v will increase.

At or adjacent to a mid-point of the movement (FIG. 4), the guide element 41 will reach a position at or adjacent to the end of the guideway 39 which is nearest to the main pivotable axis. The torque T applied to the sling hanger 14 will reach a minimum, and the angular speed v of the sling hanger 14 will reach a maximum.

Thereafter, the guide element 41 will move back along the guideway 39 and the torque T applied to the sling hanger 14 will gradually increase again and the angular speed v will gradually decrease until the sling hanger 14 reaches its second extreme position (FIG. 5*c*).

When reversing the above described operation, the only substantial difference lies in the use of a constant rate of retraction, instead of extension, of the linear actuator 35.

Figure 6:
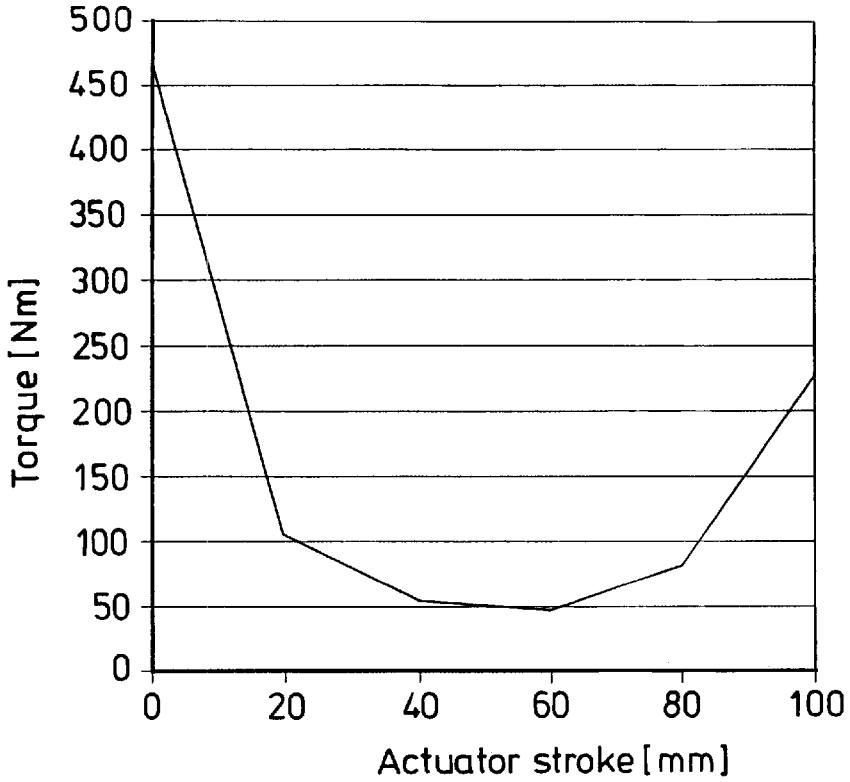
FIG. 6 is a graph of torque applied to the lifting element against actuator stroke.

FIG. 6 is a rough graph of the torque (T) applied to the sling hanger 14 by the power operated mechanism 31 plotted against actuator stroke length based on 1 KN actuator force. As will be apparent, the torque T decreases from one extreme position towards an intermediate position and then increases again as the sling hanger moves from the intermediate position towards its other extreme position.

Figure 7:
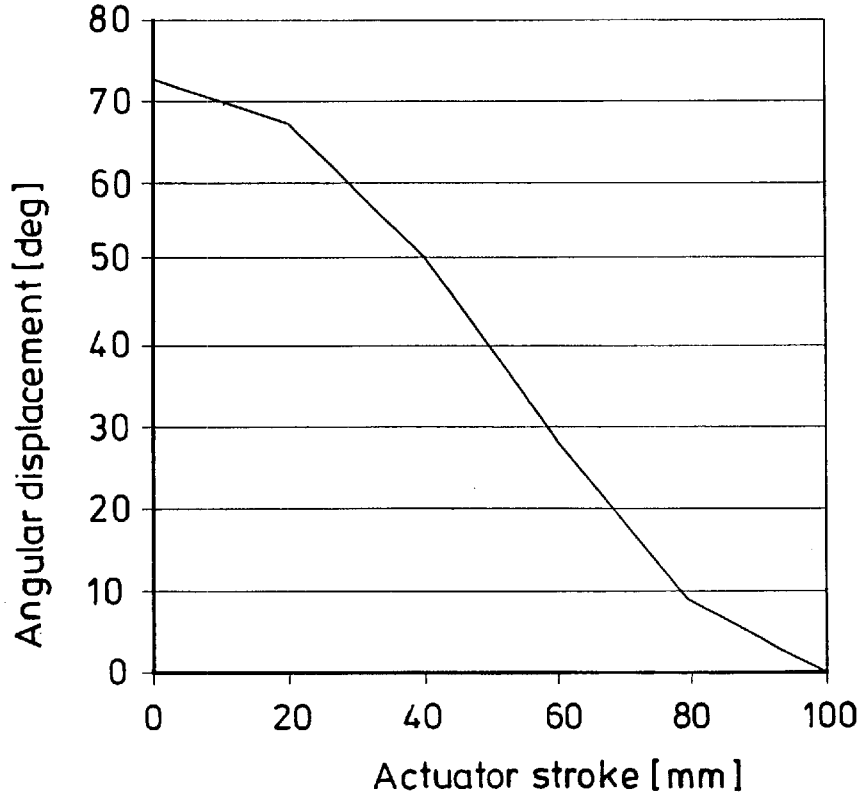
FIG. 7 is a graph of angular displacement of the lifting element against actuator stroke.

FIG. 7 is a rough graph of angular displacement of the sling hanger 14 against actuator stroke. As will be apparent, the change in angular displacement is smaller per unit increase in actuator stroke towards the two ends of the stroke length and this demonstrates that the angular speed of the sling hanger increases as it moves away from one extreme position and decreases as it approaches its other extreme position.

It should be noted that the above-described arrangement can also be directly applied to the first type of invalid positioning devices mentioned hereinbefore.

It is therefore possible to provide an invalid positioning device with a power assisted lifting element having more suitable torque and angular speed characteristics than hitherto resulting in quicker and more accurate operation of the lifting element in the range in which the device is most commonly used. It is also possible to locate the motor of the actuator at an elevated position relative to the main horizontal axis.

The invalid positioning device described above is given by way of example only and various modifications will be apparent to persons skilled in the art without departing from the scope of the invention.

What is claimed is:

1. An invalid positioning device comprising a support structure, a lifting element angularly displaceable about a main horizontal axis relative to the support structure between two extreme positions and a power operated mechanism for pivoting the lifting element about said main horizontal axis, the power operated mechanism being arranged such that the torque applied by the power operated mechanism decreases as the lifting element moves away from one extreme position and increases as the lifting element approaches its other extreme position and such that the angular speed of the lifting element increases as it moves away from one extreme position and decreases as it approaches its other extreme position.

2. The invalid positioning device according to claim 1, wherein the power operated mechanism comprises an actuator and a lever having a first part and a second part, said first part being supported for pivotable movement relative to the support structure about a second horizontal axis spaced from said main horizontal axis, and said second part being connected to the lifting element by a slidable connection.

3. The invalid positioning device according to claim 2, wherein said second horizontal axis is parallel to and in fixed spaced relationship to the main horizontal axis.

4. The invalid positioning device according to claim 2, wherein the arrangement is such that the slidable connection moves closer to said main horizontal axis as the lifting element moves away from one extreme position towards an intermediate position and then moves away from said main horizontal axis as the lifting element moves from said intermediate position towards its other extreme position.

5. The invalid positioning device according to claim 2, wherein the actuator is a linear actuator.

6. The invalid positioning device according to claim 5, wherein one end of the linear actuator is supported for pivotable movement relative to the support structure, and the other end is supported for pivotable movement relative to a third part of the lever.

7. The invalid positioning device according to claim 2, wherein the lifting element has a guideway, and the second part of the lever includes a guide element slidable in said guideway.

8. The invalid positioning device according to claim 1, wherein the support structure comprises a lifting arm and a sling hanger support angularly displaceable relative to the lifting arm about a vertical or substantially vertical axis, and the lifting element comprises a sling hanger; the sling hanger support being of generally U-shaped configuration, and having two limbs and the sling hanger including a generally U-shaped part having two limbs which are pivotally connected to lower ends of the two limbs of the sling hanger support, respectively, by which said main horizontal axis is defined; the sling hanger presenting two spaced sling attachment points on one side of the main horizontal axis and at least one sling attachment point on the other side of the main horizontal axis for connection of a first pair of sling attachments to one side of the main horizontal axis and for connection of a second pair of sling attachments to the opposite side of the horizontal axis.

9. An invalid positioning device comprising a support structure, a lifting element angularly displaceable about a main horizontal axis relative to the support structure between two extreme positions and a power operated mechanism for pivoting the lifting element about said main horizontal axis, wherein the power operated mechanism comprises an actuator and a lever having a first part and a second part, said first part being supported for pivotable movement relative to the support structure about a second horizontal axis spaced from said main horizontal axis, and said second part being connected to the lifting element by a slidable connection which moves closer to said main horizontal axis as the lifting element moves away from one extreme position towards an intermediate position and then moves away from said main horizontal axis as the lifting element moves from said intermediate position towards its other extreme position.

10. The invalid positioning device according to claim 9, wherein the support structure comprises a lifting arm and a sling hanger support angularly displaceable relative to the lifting arm about a vertical or substantially vertical axis, and the lifting element comprises a sling hanger; the sling hanger support being of generally U-shaped configuration and having two limbs, and the sling hanger including a generally U-shaped part having two limbs which are pivotally connected to lower ends of the two limbs of the sling hanger support, respectively, by which said main horizontal axis is defined, the sling hanger presenting two spaced sling attachment points on one side of the main horizontal axis, and at least one sling attachment point on the other side of the main horizontal axis for connection of a first pair of sling attachments to one side of the main horizontal axis and for connection of a second pair of sling attachments to the opposite side of the horizontal axis.

11. The invalid positioning device according to claim 10, wherein the actuator is a linear actuator.

12. An invalid positioning device according to claim 11, wherein one end of the linear actuator is supported for pivotable movement relative to the support structure, and the other end is supported for pivotable movement relative to a third part of the lever.

13. An invalid positioning device according to claim 12, wherein said one end of the linear actuator is supported for pivotable movement by the sling hanger support.

* * * * *